US008667767B1

(12) United States Patent
Ciancio

(10) Patent No.: US 8,667,767 B1
(45) Date of Patent: Mar. 11, 2014

(54) AUTOMATIC REFUSE BAG RELEASE DEVICE AND METHOD OF USING THE SAME

(71) Applicant: Chad V. Ciancio, North Versailles, PA (US)

(72) Inventor: Chad V. Ciancio, North Versailles, PA (US)

( * ) Notice: Subject to any disclaimer, the term of this patent is extended or adjusted under 35 U.S.C. 154(b) by 0 days.

(21) Appl. No.: 13/887,582

(22) Filed: May 6, 2013

Related U.S. Application Data

(63) Continuation of application No. 13/785,576, filed on Mar. 5, 2013.

(51) Int. Cl.
*B65B 7/00* (2006.01)

(52) U.S. Cl.
USPC ..... 53/285; 53/266.1; 53/480

(58) Field of Classification Search
USPC ..... 53/285, 270, 266.1, 281, 323, 324, 480
See application file for complete search history.

(56) References Cited

U.S. PATENT DOCUMENTS

| | | | | |
|---|---|---|---|---|
| 3,827,352 | A * | 8/1974 | Stratman et al. | 100/229 A |
| 4,328,654 | A * | 5/1982 | Van Ginkel et al. | 53/285 |
| 5,042,374 | A * | 8/1991 | Klepacki | 100/229 A |
| 5,588,358 | A * | 12/1996 | Klepacki et al. | 100/349 |
| 7,832,587 | B2 * | 11/2010 | West | 220/262 |
| 2007/0024166 | A1 * | 2/2007 | Sung | 312/319.9 |

* cited by examiner

*Primary Examiner* — Sameh H. Tawfik
(74) *Attorney, Agent, or Firm* — Acker Wood IP Law, LLC; Gwen R. Acker Wood

(57) ABSTRACT

The present invention provides a device and method for automatic release of a refuse bag from a refuse receptacle. The device and method provided herein substantially eliminates all contact by a user with a filled refuse bag and the unsanitary contents therein.

17 Claims, 12 Drawing Sheets

AUTOMATIC REFUSE BAG RELEASE DEVICE AND METHOD OF USING THE SAME

CROSS REFERENCE TO RELATED APPLICATIONS

The present application is a continuation application of U.S. patent application Ser. No. 13/785,576, filed Mar. 5, 2013, which is incorporated by reference herein in its entirety.

FIELD OF THE INVENTION

The present invention relates to sanitary disposal of refuse. In particular, the present invention relates to an automatic refuse bag release device and method of using the same, which substantially eliminates all contact of a user with contents of a refuse bag.

BACKGROUND OF THE INVENTION

There are many types and sizes of refuse, or garbage, bag receptacles on the market for sale to residential or commercial consumers. In most designs, the receptacles have a closure, such as a removable top cover or an attached moveable top cover, to conceal the contents, reduce odors, and inhibit escape of bacteria into the surrounding environment.

All refuse bag receptacles, however, require some manual manipulation of the refuse bag contained therein when the bag is removed from the receptacle as well as to close the bag after removal. Such manipulations can result in some degree of physical contact by the user of unsanitary contents of the bag. Depending on the contents of the refuse bag, this can pose a health and/or safety hazard to the user, especially if the user is frail or immune-compromised.

There exists a real need for a refuse bag receptacle device that allows a user to remove refuse bags from a receptacle while ensuring substantially no physical contact of the user with the contents of the refuse bag.

SUMMARY OF THE INVENTION

The present invention fulfills this need by providing a device and method to automatically release a refuse bag from a receptacle, substantially eliminating the possibility of physical contact of the contents of the refuse bag by the user.

In an aspect of the invention, there is provided a device for automatically releasing a refuse bag from a receptacle. The device comprises a housing having a first end side, a second end side, a front side and a back side. The housing has an opening which defines an interior space therein. The opening contains an automatic lock and release compartment positioned atop a refuse bag compartment.

The automatic lock and release compartment is comprised of a first support panel and a second support panel, each panel having a front end and a back end. The first and second support panels are configured to accept an open end of a refuse bag placed thereon so that the refuse bag is suspended downwardly in the interior space of the refuse bag compartment. A first bag support chamber and a second bag support chamber are located atop the first and second support panels, respectively. Each bag support chamber contains a plurality of bag hooks for placing a first drawstring and a second drawstring tie of a refuse bag thereon, respectively.

A first strike plate and a second strike plate are located atop the first and second bag support chambers, respectively. A first hinge located in the center of the first support panel and a first backstop located at the bottom end of the first support panel, and a second hinge located in the center of the second support panel and a second backstop located at the bottom end of the second support panel are provided for securing the first and second support panels to the first and second end sides of the housing, respectively.

The device also comprises a first spring-loaded catch mechanism on the first end of the housing and a second spring-loaded catch mechanism on the second end of the housing. The first and second catch mechanisms are configured to attach to the first and second strike plates, respectively.

The device further comprises a first lock cable and a second lock cable, each having a first end and a second end. The first end attaches to the bag support chambers and the second end attaches to a support panel lock switch located in the front end of the housing.

The device further comprises a first release cable and a second lock cable, each having a first end and a second end. The first end attaches to the catch mechanisms and the second end attaches to a support panel release switch located in the front end of the housing.

In another aspect of the invention, there is provided a method for automatically releasing a refuse bag from the device described above. The method comprises placing the open end of the refuse bag on the first and second support panels; placing the first refuse drawstring tie on the plurality of hooks in the first bag support chamber and the second refuse drawstring tie on the plurality of hooks in the second bag support chamber, rotating the support panel release switch to release the open end of the refuse bag from the first and second support panels so that the opening of the refuse bag closes and is pulled down by gravity to hang in the refuse bag compartment by the drawstring ties; unhooking the first and second drawstring ties of the refuse bag from the plurality of hooks; and removing the closed refuse bag from the device.

BRIEF DESCRIPTION OF THE DRAWINGS

A fuller understanding of the invention can be gained from the following description when read in conjunction with the accompanying drawings in which.

DETAILED DESCRIPTION OF THE INVENTION

Figure 1:
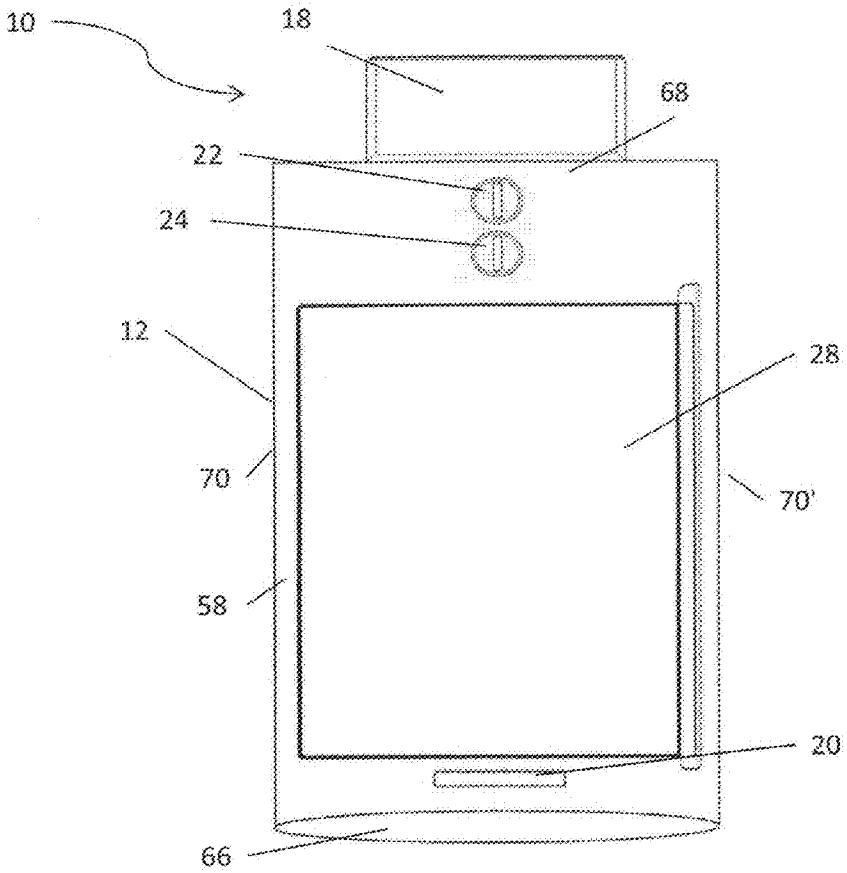
FIG. 1 is a front view of the automatic refuse bag release device, according to the embodiments of the invention.

As used herein, the terms "refuse," "garbage" and "waste" are meant to be interchangeable.

As used herein, the terms "refuse bag," "garbage bag" and "bag" are meant to be interchangeable.

As used herein, the terms "receptacle," "refuse container," "garbage container," "container" and "housing" are meant to be interchangeable.

As used herein, the terms "drawstring ties," "drawstrings" and "ties" are meant to be interchangeable.

A complete understanding of the present invention will be obtained from the following description taken in connection with the accompanying drawing figures, wherein like reference characters identify like parts throughout.

Referring now to FIGS. 1-12, the present invention provides a device 10 for automatically releasing a refuse bag 46 from a housing 12. The housing 12 has a first end side 70 and a second end side 70', a front side 58 and a back side 58' (best shown in FIG. 7). The housing 12 has an opening defining an interior space 66 therein (best shown in FIGS. 2-5 and 7 and 9-11). The interior space 66 contains an automatic lock and release compartment 14 positioned atop a refuse bag compartment 16 (best shown in FIGS. 9 and 10).

The automatic lock and release compartment 14 includes a first support panel 30 and a second support panel 30' (best shown in FIGS. 2-6, 9 and 10). The first and second support panels 30, 30' each has a front end 56*a*, 56*a'* and a back end 58*b*, 56*b'* (best shown in FIGS. 4-6). The first and second support panels 30, 30' are configured to accept an open end 64 of a refuse bag 46 placed thereon so that the refuse bag 46 is suspended downwardly in the interior space 66 of the refuse bag compartment 16 (best shown FIG. 9).

The automatic lock and release compartment 14 includes a first bag support chamber 32 and a second bag support chamber 32', located atop the first support panel 30 and the second support panel 30', respectively. The first and second bag support chambers 32, 32' each contains a plurality of bag hooks. In an embodiment, the first bag support chamber 32 contains a first bag angle hook one 38*a*, a first bag angle hook two 38*b*, and a first straight hook 38*c*; and the second bag support chamber 32' contains a second bag angle hook one 38*a'*, a second bag angle hook two 38*b'*, and a second straight hook 38*c'* (best shown in FIGS. 4 and 5). The device 10 is configured so that a first drawstring tie 48 of a refuse bag may be placed on the plurality of hooks in the first bag support chamber 32, and a second drawstring tie 48' of the refuse bag 46 may be placed on the plurality of hooks in the second bag support chamber 32' (best shown in FIGS. 7 and 10).

Figure 2:
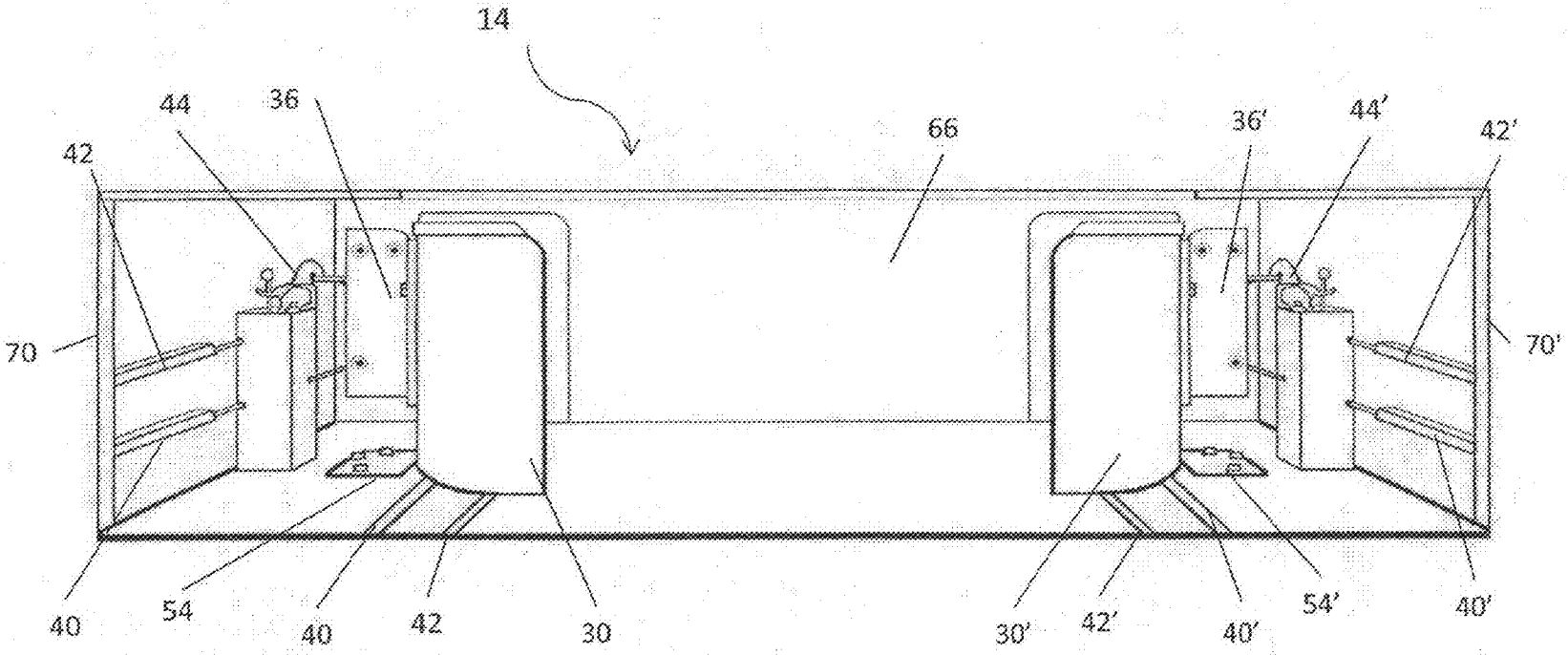
FIG. 2 is a front view of the automatic lock and release compartment, according to the embodiments of the invention.

The first and second support panels 30, 30' each includes a first hinge 36 and second hinge 36' thereon, respectively; and a first backstop 54 and a second backstop 54' (best shown in FIG. 2). The first and second hinges 36, 36' and the first and second backstops 54, 54' secure the first and second support panels 30, 30' to the first and second end sides 70, 70' of the housing 12.

Figure 6:
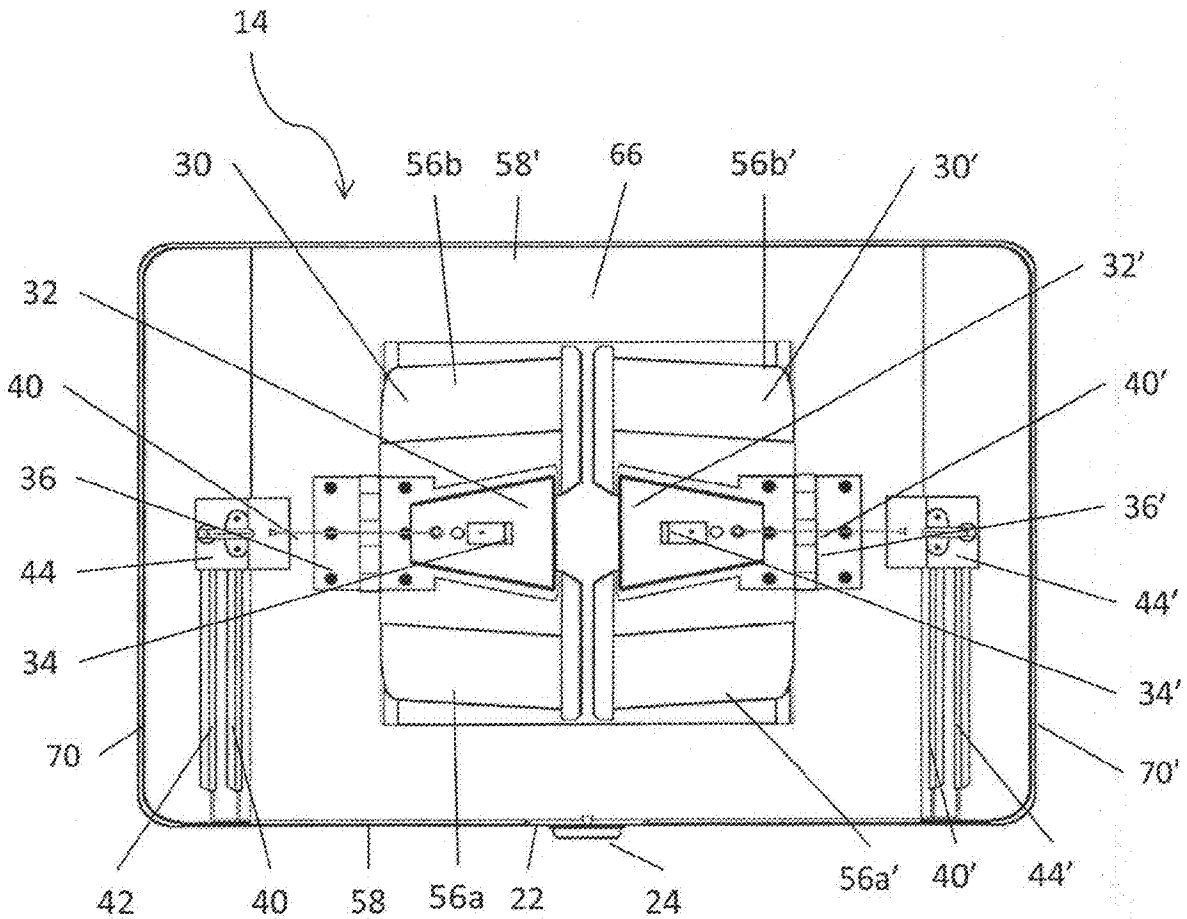
FIG. 6 is a top view of the automatic lock and release compartment showing support panels in a released, downward position, according to the embodiments of the invention.
Figure 7:
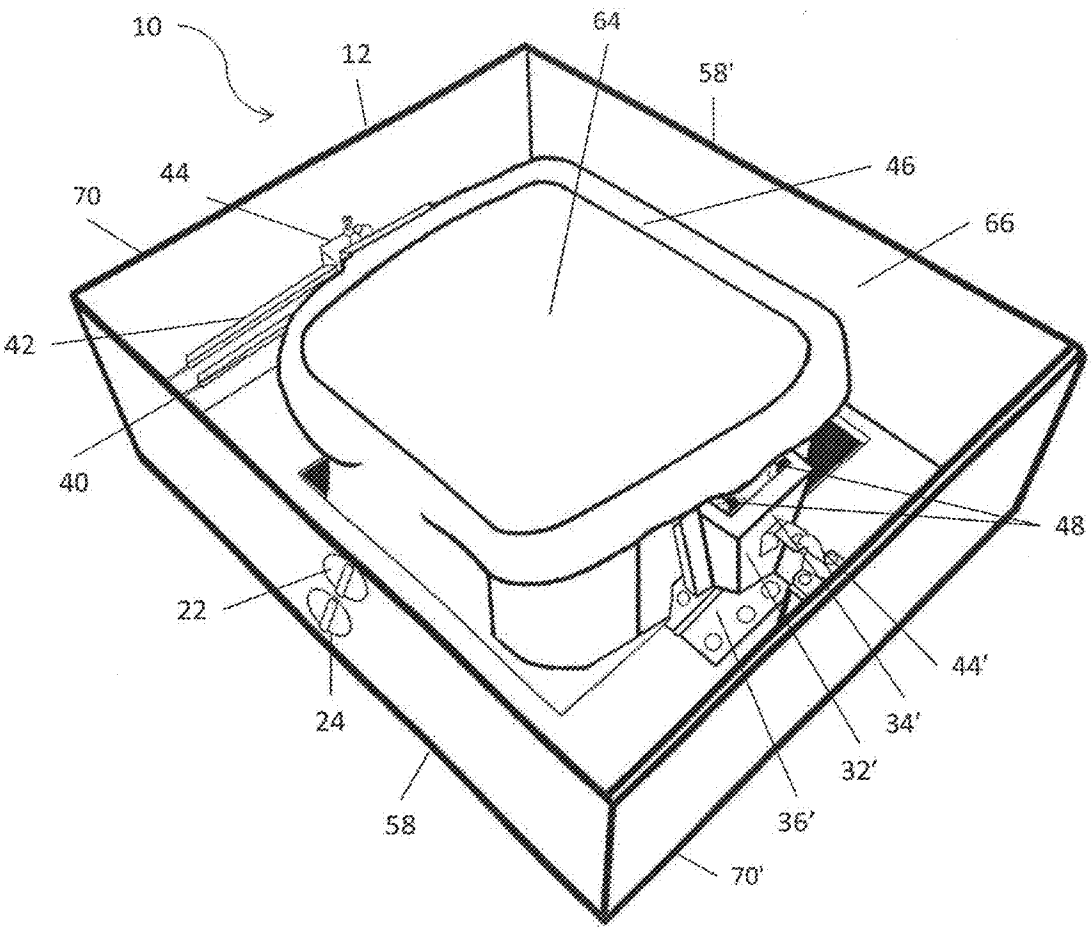
FIG. 7 is a perspective view of the automatic lock and release compartment showing support panels in a locked, upward position with a refuse bag contained thereon, according to the embodiments of the invention.

A first strike plate 34 is located atop the first bag support chamber 32, and a second strike plate 34' is located atop the second bag support chamber 32 (best shown in FIG. 6). A first spring-loaded catch mechanism 44 located at the first end side 70 in the interior 66 of the housing 12 is configured to receive the first strike plate 34, and a second spring-loaded catch mechanism 44' located at the second end side 70' in the interior 66 of the housing 12 is configured to receive the second strike plate 34' (best shown in FIGS. 2, 3, 6 and 7).

As shown in FIGS. 2-6, the first and second support panels 30, 30' open and close, i.e., are locked in place and are released, by way of a first lock cable 40, a second lock cable 40', a first release cable 42 and a second release cable 42'. The first and second lock cables 40, 40' and the first and second release cables 42, 42' each has a first end and a second end (not shown). The first ends of the first and second lock cables 40, 40' are attached to the first and second bag support chambers 32, 32', respectively; and the second ends of the first and second lock cables each are attached to a support panel lock switch 22 located in the front end 58 of the housing 12. The first ends of the first and second release cables 42, 42' are attached to the first and second spring-loaded catch mechanisms 44, 44', respectively; and the second ends of the first and second release cables each are attached to a support panel release switch 24 located in the front end 58 of the housing 12.

When the support panel lock switch 22 is turned, this pulls on the lock cables to open, i.e., lock, the first and second support panels in an upwardly direction so that the first strike plate 34 engages the first catch mechanism 44 and the second strike plate 34' engages the second catch mechanism 44'. When the support panel release switch 24 is turned, this pulls on the release cables to close, i.e., release, the first and second support panels 30, 30' in a downwardly direction, so that the open end 64 of the refuse bag 46 is released from the first and second support panels 30, 30', the refuse bag 46 drops downwardly in the interior space 66 of the refuse bag compartment 16 by force of gravity, which also closes the opening 64 of the refuse bag 46, with the refuse bag being suspended by the first and second ties 48, 48'. The first and second ties 48, 48' of the refuse bag 46 then can be disengaged easily from the plurality of hooks by a user without the user coming in contact with the contents of the refuse bag 46.

Figure 8:
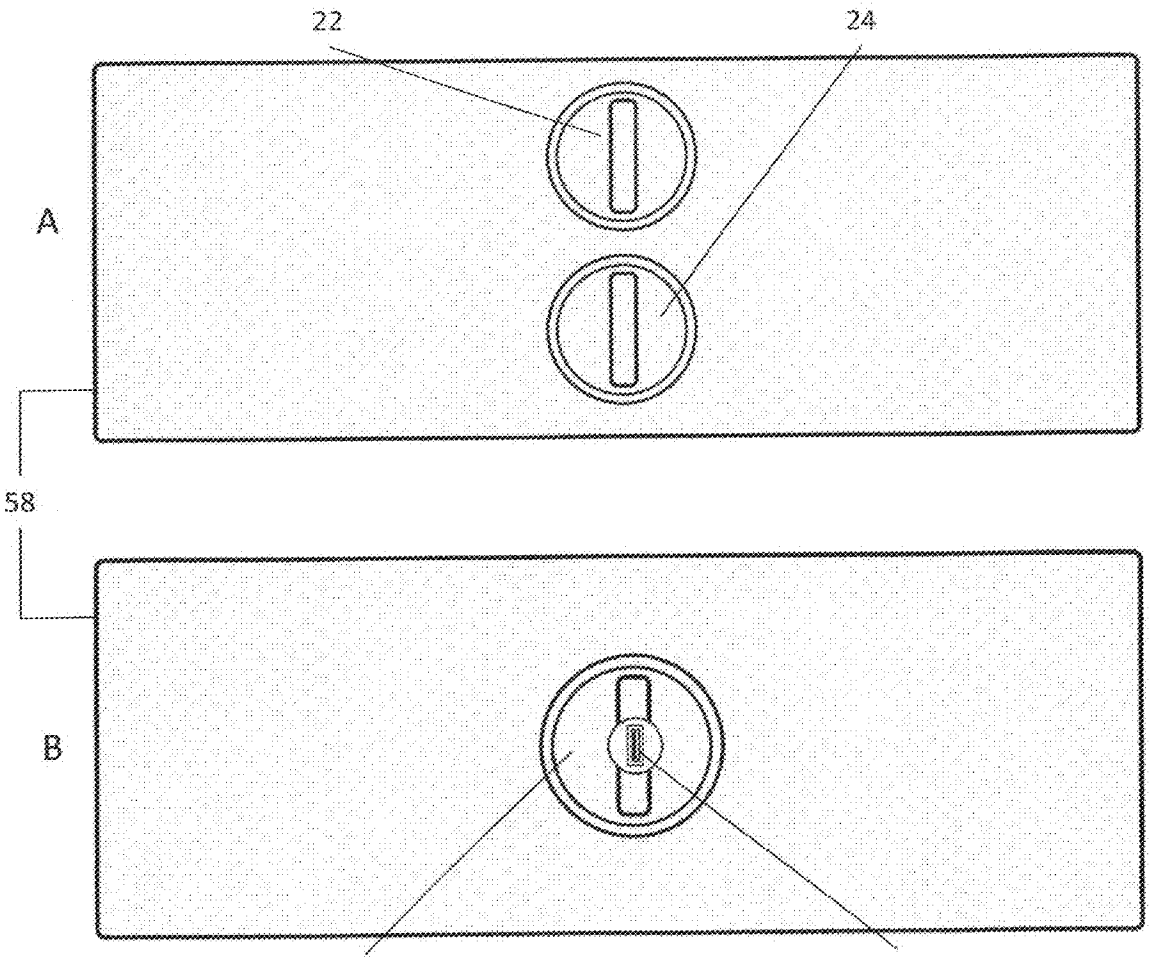
FIG. 8 is a front view of (A) a support panel lock switch and a support panel release switch; and (B) a combined support panel lock and release switch, according to the embodiments of the invention.
Figure 9:
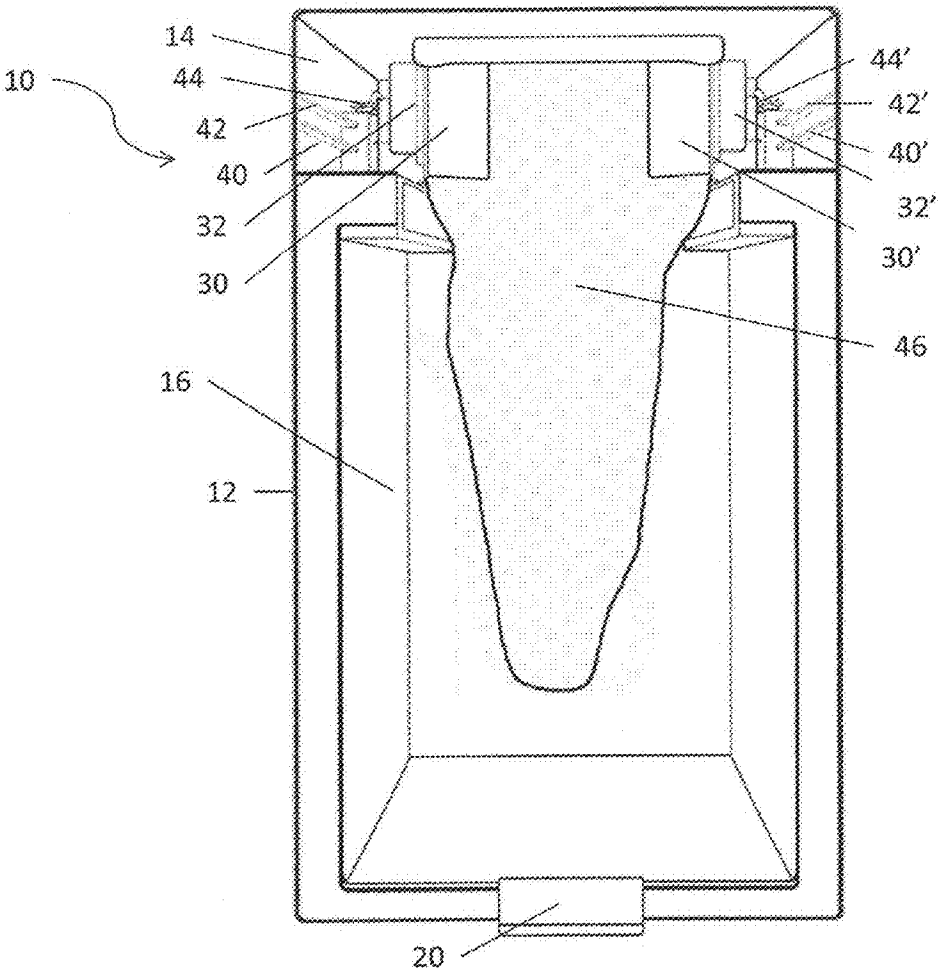
FIG. 9 is a front view of the automatic refuse bag release device showing a refuse bag positioned on locked refuse bag support panels in the automatic lock and release compartment, and hanging down in the refuse bag compartment, according to the embodiments of the invention.
Figure 10:
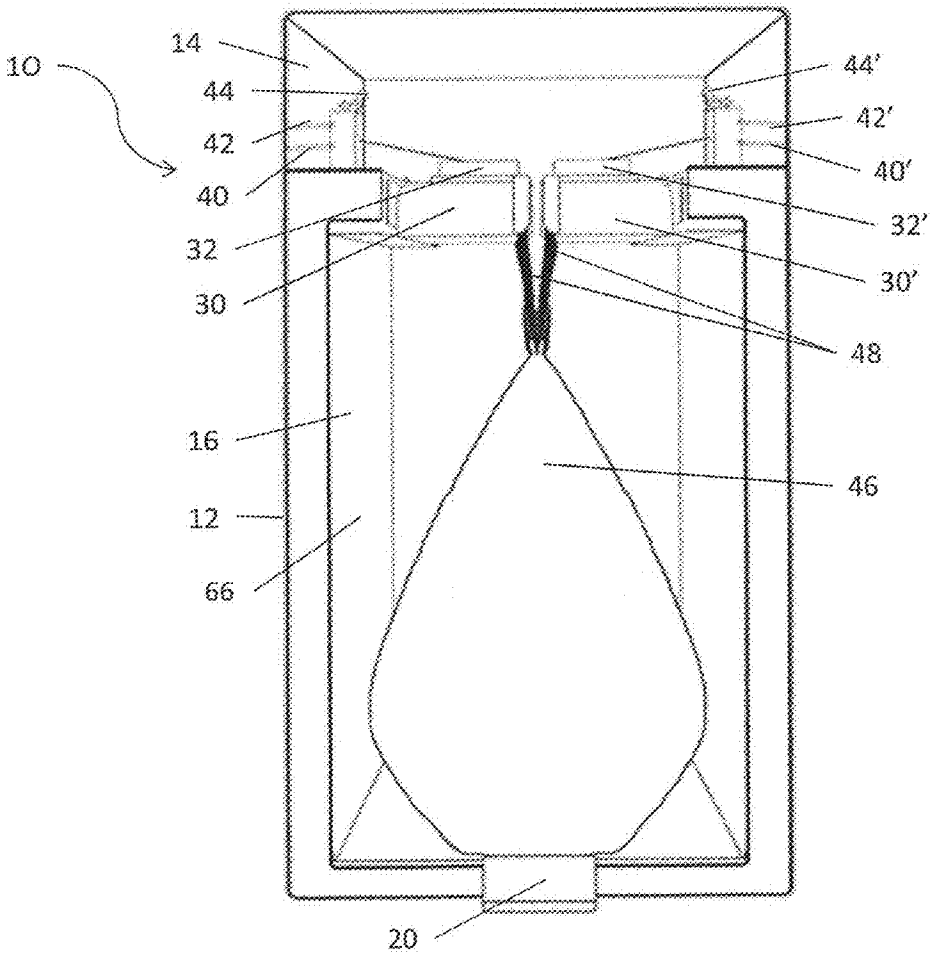
FIG. 10 is a front view of the automatic refuse bag release device showing released refuse bag support panels in the automatic lock and release compartment, and a closed refuse bag hanging by its ties in the refuse bag compartment, according to the embodiments of the invention.
Figure 11:
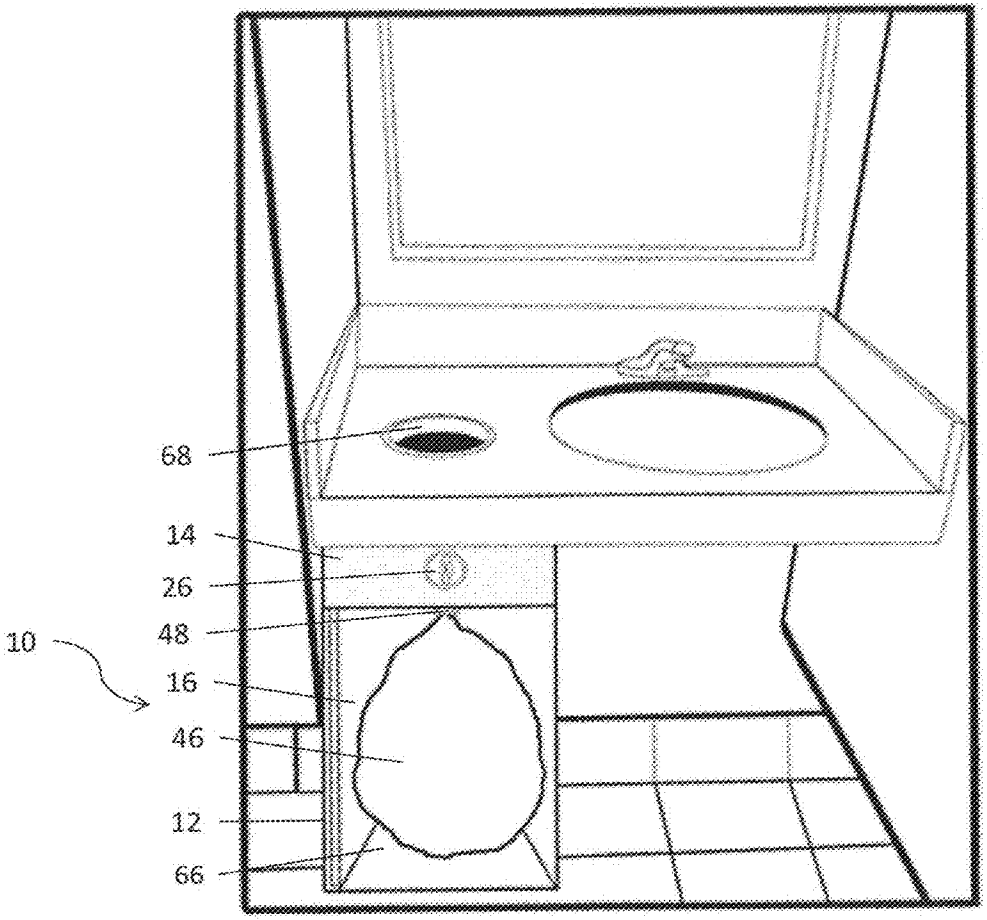
FIG. 11 is a perspective view of the automatic refuse bag release device in an embodiment configured for a bathroom facility.

In another embodiment, the seconds ends of the first and second lock cables 40, 40' and the second ends of the first and second release cables 42, 42' may be attached to a combination lock and release switch 26, respectively, such that rotation of the combination switch 26 in one direction, such as in a clockwise direction, opens, i.e., locks, the first and second support panels 30, 30', and rotation of the combination switch 26 in the opposite direction, such as in a counterclockwise direction, closes, i.e., releases, the first and second support panels 30, 30'. FIG. 8 best shows the lock switch 22, the release switch 24, and the combination lock and release switch 26. The combination lock and release switch 26 may include a key lock 62 which allows a user to lock the doors of the housing 12 of the device 10 for security purposes, for example, when the device 10 is used in public areas, such as restaurants, public restrooms, parks and the like.

Figure 3:
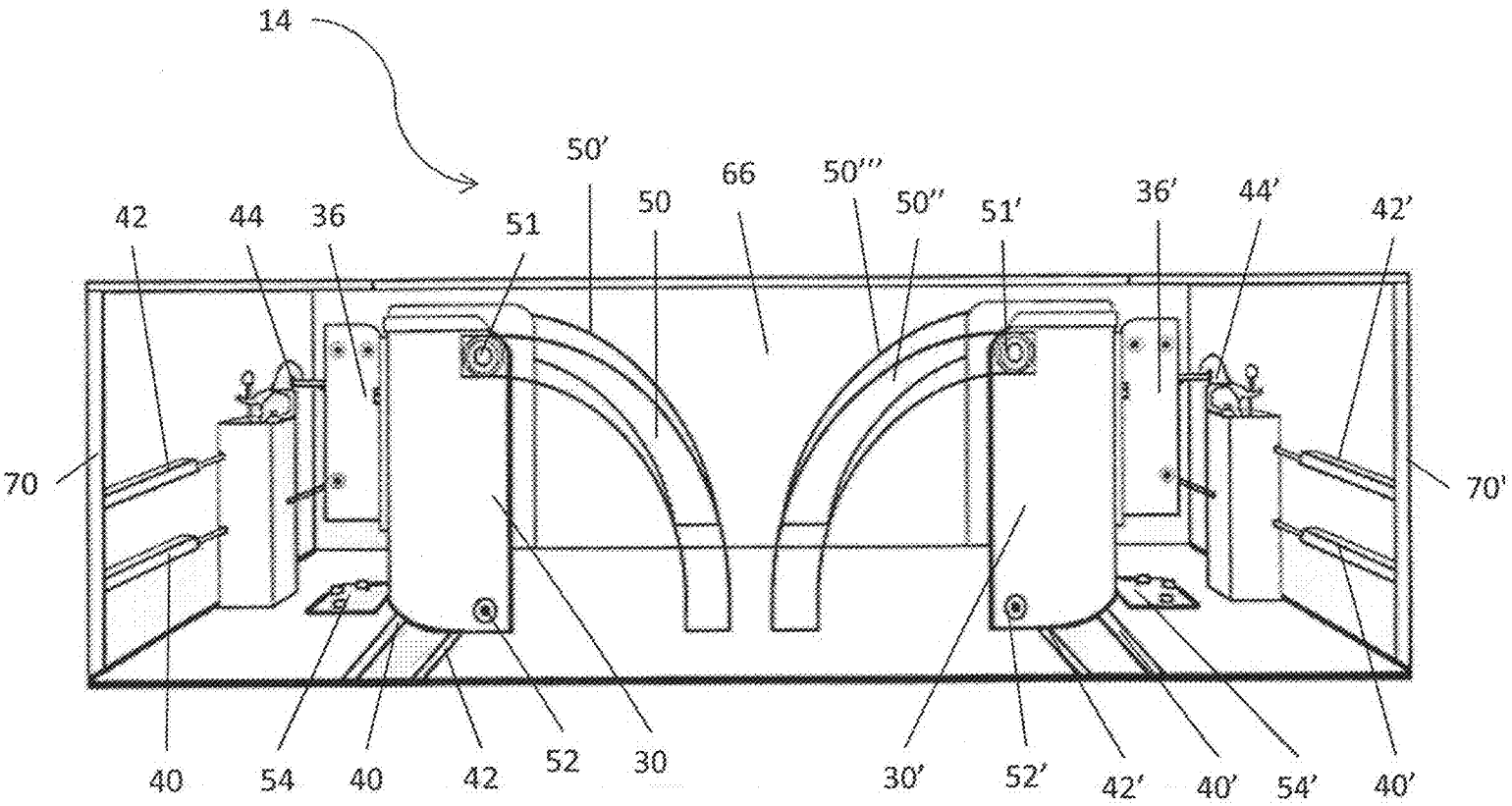
FIG. 3 is a front view of the automatic lock and release compartment with additional heavy support tracks, according to the embodiments of the invention.
Figure 4:
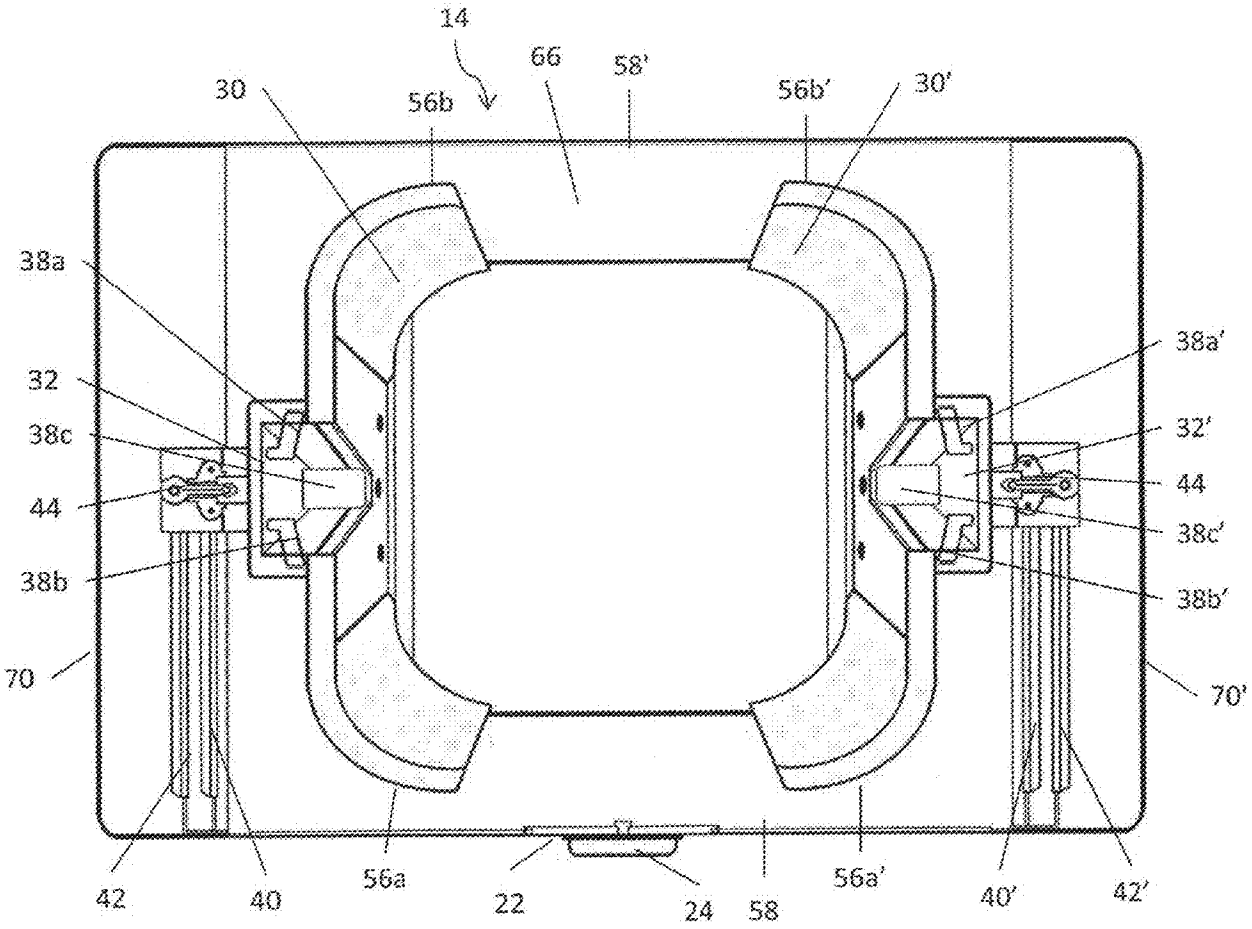
FIG. 4 is a top view of the automatic lock and release compartment showing support panels in a locked, upward position, according to the embodiments of the invention.
Figure 5:
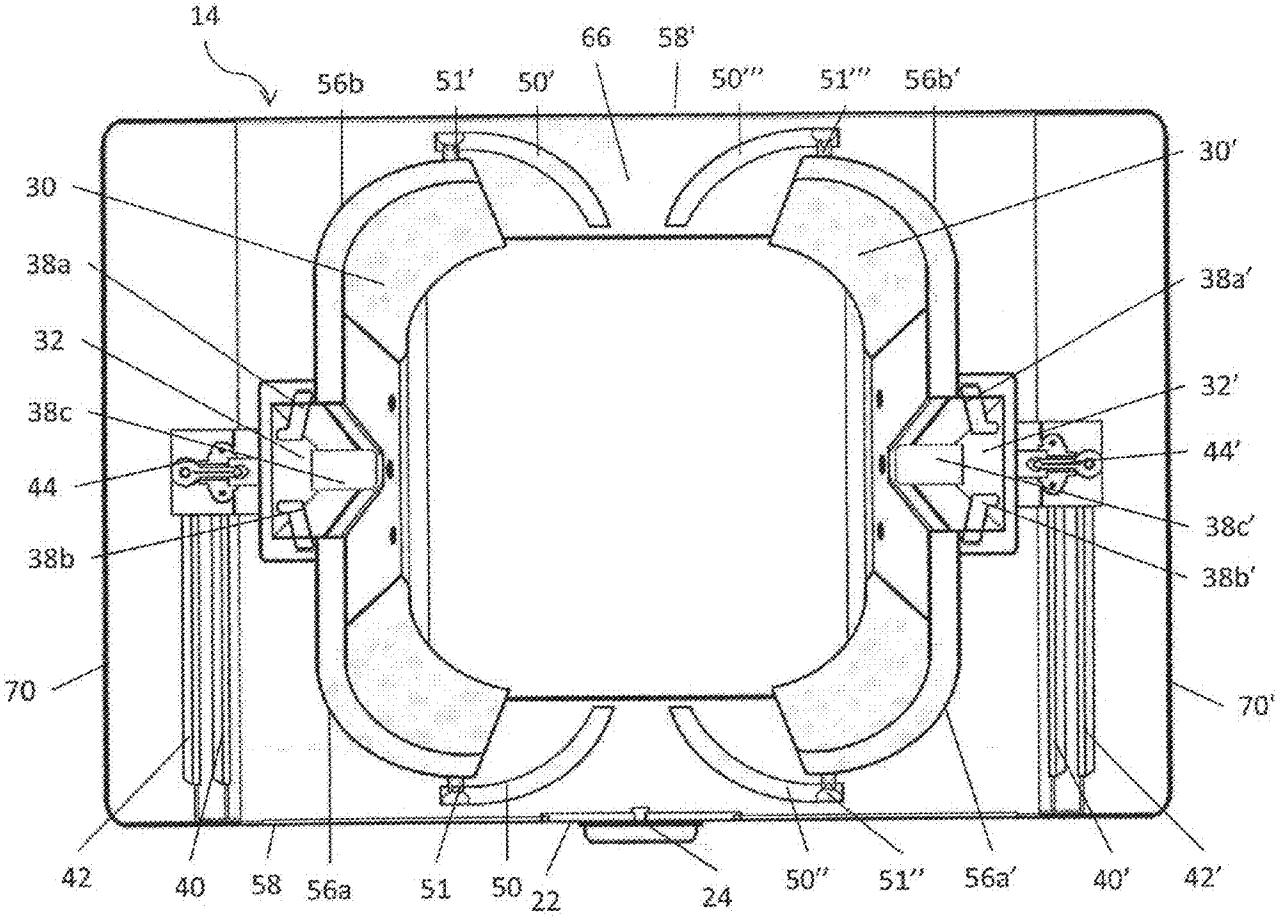
FIG. 5 is a top view of the automatic lock and release compartment showing support panels in a locked upward position, with additional heavy support tracks, according to the embodiments of the invention.

In an embodiment, shown in FIGS. 3 and 5, the first and second support panels 30, 30' may be reinforced with track plates to allow for placement of heavier weighted refuse bags so that the support panels do not bend or buckle: the first support panel 30 having a first track 50 on its front end 56*a* and a second track 50' on its back end 56*b*; and the second support panel 30' having a first track 50" on its front end 56*a*' and a second track 50'" on its back end 56*b*' (best shown in FIG. 5). Each of the four tracks 50, 50', 50", 50'" has a groove containing a slideable bearing 51, 51', 51", 51'" therein, respectively. The first track 50 is secured at one end to the front end 56*a* of the first support panel 30, the second track 50' is secured at one end to the back end 56*b* of the first support panel 30, the third track 50" is secured at one end to the front end 56*a*' of the second support panel 30' and the fourth track 50'" is secured at one end to the back end 56*b*' of the second support panel 30'. The opposite ends of the first and the third tracks 50, 50" are secured to the front end 58 of the housing 12, and the opposite ends of the second and fourth tracks 50' and 50'" are secured to the back end 58' of the housing 12.

Figure 12:
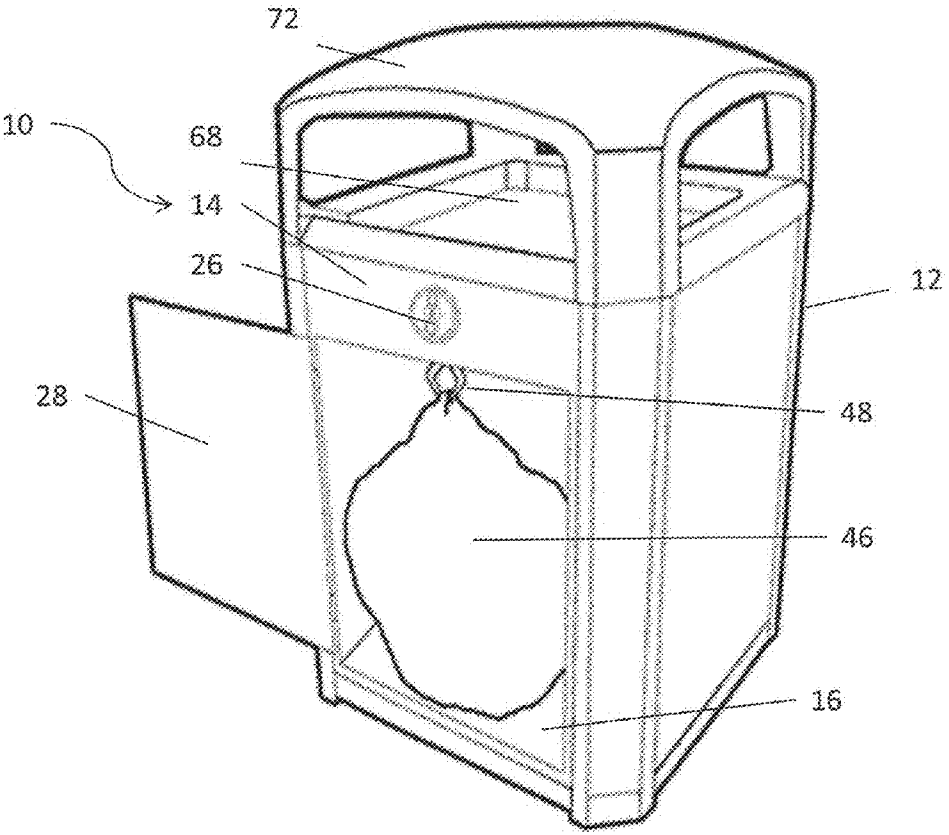
FIG. 12 is a perspective view of the automatic refuse bag release device in an embodiment configured for outdoor use.

In an embodiment, the front 58 of the housing 12 includes a front door 28 which covers the front of the refuse bag compartment 16 (shown in FIGS. 1 and 12). In addition to the front door 28, the entire device 10 can be configured to move in and out of an opening, i.e., a drawer, for placement under a sink in a kitchen or bathroom (shown in FIG. 11).

In an embodiment, the opening 68 to the interior space 66 of the housing 12 includes a top door 18 which covers the opening 68 to the interior space 66. Also included may be a front pedal top door opener 20 on the front side 58 of the housing 12 which opens the top door 18 when pressed (shown in FIG. 1). In another embodiment, the opening 68 to the interior space 66 of the housing 12 may include a cover 72 having a plurality of openings (shown in FIG. 12) which allows a user to easily discard refuse without needing to open a top door or slide a drawer in and out Any suitable shape of the housing is contemplated for use in the invention, such as, without limitation, a rectangular or cylindrical shape.

In an embodiment, the cross-section of the interior space of the automatic lock and release compartment and the refuse bag compartment are equal. In another embodiment, the cross-section of the interior space of the automatic lock and release compartment is smaller than the cross-section of the interior space of the refuse bag compartment.

The dimensions of the device can vary depending on the size of the refuse bag installed therein. For example, and without limitation, the dimensions of the device for installation of kitchen-sized bags of about 24 inches long and 22 wide are as follows. The height can range from about 20 inches to about 50 inches, and the width can range from about 12 inches to about 40 inches. In an embodiment, the height is about 34 inches and the width is about 16 inches. The support panels can range from about 5 inches to about 15 inches long, about 3 inches to about 12 inches wide and about 1/16 inch to about 1 inch thick. In an embodiment, the length is about 10 inches, the width is about 6 inches and the thickness is about 1/4 inch. The length of the bag support chambers can range from about 2 inches to about 6 inches, and the width can range from about 1 inch to about 4 inches wide. In an embodiment, the length is about 3 inches and the width is about 2 inches. When the device is rectangular in shape, the interior space of the housing can range from about 8 inches to about 12 inches long, and about 5 inches to about 10 inches wide. In an embodiment, the length is about 10 inches and the width is about 8 inches. When the device is cylindrical in shape, the diameter of the interior space of the housing can range from about 5 inches to about 12 inches. In an embodiment, the diameter is about 10 inches.

The dimensions of the device for installation of large refuse bags of about 31 inches long and about 29 inches wide are, for example and without limitation, as follows. The height can range from about 30 inches to about 80 inches, and the width can range from about 20 inches to about 50 inches. In an embodiment, the height is about 40 inches and the width is about 35 inches. The support panels can range from about 4 inches to about 20 inches long, about 4 inches to about 16 inches wide, and about 1/16 inch to about 2 inches thick. In an embodiment, the length is about 12 inches, the width is about 8 inches and the thickness is about 1/4 inch. The length of the bag support chambers can range from about 3 inches to about 15 inches, and the width can range from about 2 inches to about 6 inches. In an embodiment, the length is about 6 inches and the width is about 3 inches. When the device is rectangular in shape, the interior space of the housing can range from about 10 inches to about 20 inches long, and about 5 inches to about 15 inches wide. In an embodiment, the length is about 15 inches and the width is about 13 inches. When the device is cylindrical in shape, the diameter of the interior space of the housing can range from about 5 inches to about 15 inches. In an embodiment, the diameter is about 13 inches.

Spring-loaded catch mechanisms, hinges, cables and single or combination switches are well known by those skilled in the mechanical arts, and any suitably-sized and configured spring-loaded catch mechanism, hinge, cable, single or combination switch may be used in the embodiments of the invention.

The device may be made of plastics, aluminum, stainless steel, mild steel, galvanized steel, or combinations thereof.

The present invention also provides a method for automatically releasing a refuse bag from the device described hereinabove. The method comprises placing the open end of the refuse bag on the first and second support panels after locking the first and second support panels in place, and placing the first drawstring tie on the plurality of hooks in the first bag support chamber and the second drawstring tie on the plurality of hooks in the second bag support chamber in the automatic lock and release compartment of the device; rotating the support panel release switch to release the open end of the refuse bag from the first and second support panels, wherein the open end of the refuse bag closes, wherein the refuse bag is pulled down by gravity and hangs down into the refuse bag compartment from the first and second drawstring ties; unhooking the first and second ties of the refuse bag from the plurality of hooks; and removing the closed refuse bag from the device.

It is envisioned that the present invention may be used wherever refuse is discarded, either as a stand-alone device or placed in, on, or under a foundation, such as a kitchen or bathroom countertop. For example, and without limitation, the present invention may be used in residential homes in a kitchen, bathroom, game room, garage, baby room; in a restaurant under food preparation counters or in restaurant bathrooms; in airports; in hospitals, doctors' offices, and medical, pharmaceutical or clinical laboratories, where contamination from hazardous materials is of heightened concern; and outdoors in public and recreational areas, gas stations, and the like.

Wherever the present invention is used, the advantages of the present invention are numerous, namely, the invention provides for a cleaner environment, since substantially fewer contaminants, such as hazardous materials or microorganisms, escape from a refuse bag upon removing the bag from the device because the user does not have to manipulate the contents of the bag or pull on the drawstrings of the bag when removing the bag from the housing. The automatic closure of the bag upon release of the bag from the bag support panels also substantially eliminates all waste odor from the bag. In addition, there is less strain physically on the user, since no pulling upwards on a refuse bag is required, which is especially advantageous to people who are elderly or disabled.

It will be appreciated by those skilled in the art that changes could be made to the embodiments described above without departing from the broad inventive concept thereof. It is understood, therefore, that this invention is not limited to the particular embodiments disclosed, but it is intended to cover modifications that are within the spirit and scope of the invention, as defined by the appended claims.

What is claimed is:

1. A device to automatically release a refuse bag from a container, comprising:

a housing having a first end side, a second end side, a front side and a back side, said housing having an opening having an interior space therein, said opening containing an automatic lock and release compartment positioned atop a refuse bag compartment; said automatic lock and release compartment comprised of:

a first support panel and a second support panel, said first and second support panels each having a front end and a back end, said first and second support panels supporting an open end of a refuse bag placed thereon so that the refuse bag is suspended downwardly in the interior space of the refuse bag compartment;

a first bag support chamber located atop the first support panel; said first bag support chamber containing a plurality of bag hooks, and a second bag support chamber located atop the second support panel, said second bag support chamber containing a plurality of bag hooks, wherein a first drawstring tie of the refuse bag is placed on the plurality of hooks in the first bag support chamber and a second drawstring tie of the refuse bag is placed on the plurality of hooks in the second bag support chamber;

a first hinge and a first backstop to secure the first support panel to the first end side of the housing, and a second hinge and a second backstop to secure the second support panel to the second end side of the housing;

a first strike plate located atop the first bag support chamber, and a second strike plate located atop the second bag support chamber;

a first catch mechanism to receive the first strike plate, and a second catch mechanism to receive the second strike plate, said first catch mechanism located at the first end side in the interior of the housing, and said second catch mechanism located at the second end side in the interior of the housing;

a first lock cable having a first end and a second end, said first end attached to the first bag support chamber and said second end attached to a support panel lock switch located in the front end of the housing; and a second lock cable having a first end and a second end, said first end attached to the second bag support chamber and said second end attached to the support panel lock switch; and a first release cable having a first end and a second end, said first end attached to the first catch mechanism and said second end attached to a support panel release switch located in the front end of the housing; and a second release cable having a first end and a second end, said first end attached to the second catch mechanism and said second end attached to the support panel release switch;

wherein rotation of the support panel lock switch pulls on the first lock cable and the second lock cable to move the first support panel and the second support panel upwardly so that the first strike plate engages the first catch mechanism and the second strike plate engages the second catch mechanism, wherein rotation of the support panel release switch pulls on the first release cable and the second release cable to release engagement of the first strike plate with the first catch mechanism and the second strike plate from the second catch mechanism, so that the first support panel and the second support panel are released to move downwardly, wherein locking the support panels allows a user to place the refuse bag on the support panels, and wherein releasing the support panels releases the refuse bag from the support panels, closes the refuse bag, and drops the refuse bag into the refuse bag compartment while being supported from the drawstring ties of the refuse bag which are hooked to the plurality of hooks in the bag support chambers.

2. The device according to claim 1, wherein the plurality of hooks in the first bag support chamber and in the second bag support chamber each comprise two angle hooks and one straight hook, said straight hook located between the two angle hooks.

3. The device according to claim 1, further comprising four tracks, each of said four tracks having a groove therein, each of said grooves containing a slideable bearing therein, the first track secured at one end to the front end of the first support panel, the second track secured at one end to the back end of the first support panel, the third track secured at one end to the front end of the second support panel and the fourth track secured at one end to the back end of the second support panel; and the opposite ends of the first track and the third track secured in the front end of the housing and the opposite ends of the second track and the fourth track secured to the back end of the housing.

4. The device according to claim 1, wherein the front of the refuse bag compartment has a front door which covers the front of the refuse bag compartment.

5. The device according to claim 4, wherein the opening to the automatic lock and release compartment has a top door which covers the opening to the automatic lock and release compartment.

6. The device according to claim 5, wherein the front side of the housing has a front pedal top door opener to open the top door.

7. The device according to claim 4, wherein the combination support panel lock and release switch contains a key lock to lock the doors of the housing.

8. The device according to claim 1, wherein the shape of the housing is selected from the group consisting of rectangular and cylindrical.

9. The device according to claim 1, wherein the cross-section of the interior space of the automatic lock and release compartment and the cross-section of the interior space of the refuse bag compartment are equal.

10. The device according to claim 1, wherein the cross-section of the interior space of the automatic lock and release compartment is smaller than the cross-section of the interior space of the refuse bag compartment.

11. The device according to claim 1, wherein the support panel lock switch and support panel release switch are integrated to form a combination support panel lock and release switch.

12. The device according to claim 11, wherein clockwise rotation of the combination support panel lock and release switch locks the first and second support panels, and wherein counterclockwise rotation of the combination support panel lock and release switch releases the first and second support panels.

13. The device according to claim 1, wherein the device is manufactured from components selected from the group consisting of plastics, aluminum, stainless steel, mild steel, galvanized steel and combinations thereof.

14. The device according to claim 1, wherein the height of the housing is about 20 inches to about 50 inches, and the width is about 12 inches to about 40 inches.

15. The device according to claim 14, wherein the height of the housing is about 34 inches and the width is about 16 inches.

16. The device according to claim 1, wherein the height of the housing is about 30 inches to about 80 inches, and the width is about 20 inches to about 50 inches.

17. The device according to claim 16, wherein the height of the housing is about 40 inches and the width is about 35 inches.

* * * * *